US006925187B2

(12) United States Patent
Norris et al.

(10) Patent No.: US 6,925,187 B2
(45) Date of Patent: Aug. 2, 2005

(54) HORN ARRAY EMITTER

(75) Inventors: Elwood G. Norris, Poway, CA (US); James J. Croft, III, Poway, CA (US)

(73) Assignee: American Technology Corporation, San Diego, CA (US)

( * ) Notice: Subject to any disclaimer, the term of this patent is extended or adjusted under 35 U.S.C. 154(b) by 654 days.

(21) Appl. No.: 09/819,301

(22) Filed: Mar. 27, 2001

(65) Prior Publication Data

US 2001/0033124 A1 Oct. 25, 2001

Related U.S. Application Data

(60) Provisional application No. 60/192,778, filed on Mar. 28, 2000.

(51) Int. Cl.[7] ..... H04R 25/00

(52) U.S. Cl. ..... 381/191; 381/174; 381/116

(58) Field of Search ..... 381/339, 340, 381/341, 342, 343, 174, 191, 113, 116; 367/181, 189, 170, 174; 29/25.41, 594

(56) References Cited

U.S. PATENT DOCUMENTS

| | | | | |
|---|---|---|---|---|
| 3,136,867 A | | 6/1964 | Brettell | 179/111 |
| 3,908,098 A | * | 9/1975 | Kawakami et al. | 367/189 |
| 4,297,538 A | * | 10/1981 | Massa | 381/340 |
| 4,322,877 A | | 4/1982 | Taylor | 29/25.35 |
| 5,142,511 A | | 8/1992 | Kanai et al. | 367/164 |
| 5,590,212 A | | 12/1996 | Uryu et al. | 381/191 |
| 6,744,899 B1 | * | 6/2004 | Grunberg | 381/343 |

OTHER PUBLICATIONS

Multi–Horn Matching Plate for Ultrasonic Transducers by Neville H. Fletcher and Suszanne Thwaites, Research School of Physical Sciences and Engineering, Australian National University, Canberra ACT 2601, Australia.

* cited by examiner

*Primary Examiner*—Huyen Le
(74) *Attorney, Agent, or Firm*—Thorpe North & Western LLP

(57) ABSTRACT

A sonic emitter, horn array with enhanced emitter-to-air acoustic coupling, with particular application to ultrasonic frequencies. The emitter comprises a plate support member having opposing first and second faces separated by an intermediate plate body. The plate body includes a plurality of conduits configured as an array of acoustic horns, with a small throat opening at the first face and an intermediate horn section which diverges to a broad mouth opening at the second face. An emitter membrane is positioned in direct contact with the first face and extends across the small throat openings. The emitter membrane is biased for (i) applying tension to the membrane extending across the throat openings and (ii) displacing the membrane into a non-planar configuration.

36 Claims, 3 Drawing Sheets

HORN ARRAY EMITTER

Priority of Provisional Patent Application No. 60/192,778 filed Mar. 28, 2000 in the United States Patent Office is hereby claimed.

BACKGROUND OF THE INVENTION

1. Field of the Invention

The present invention relates to ultrasonic emitters, and more particularly to ultrasonic emitters which include impedance matching structure such as acoustic transformers having a horn configuration.

2. Prior Art

A variety of emitter devices have been developed which propagate ultrasonic energy. These include piezoelectric transducers, electrostatic emitters, mechanical drivers, etc. A challenge with the use of such devices in air is to provide impedance matching methods to enhance the efficiency of power transfer to the ambient air. For example, the wave impedance of a piezoelectric material such as barium titanate exceeds that of air by a factor of $10^5$. This extreme impedance difference severely attenuates transmission into a propagated ultrasonic beam of energy into the air.

The use of acoustic horns as transformer devices is well known with respect to most sound systems for both audio and ultrasound frequencies. Extensive research has been done detailing preferred horn configurations for specific frequency ranges. Mathematical formulas are generally available to optimize the geometry of each application for a given frequency.

A publication by Fletcher and Thwaites entitled "Multi-horn Matching Plate for Ultrasonic Transducers" *Ultrasonics* 1992, Vol 30, No. 2., discloses the use of an array of acoustic horns formed in a plate as an acoustic transformer for ultrasonic transmission into air. Based on this disclosure, FIG. 1 shows a transducer aligned with a horn plate. A spacing gap between the emitter element and throats of the respective horns is illustrated and identified as a key element in optimizing the efficiency of the horn array for ultrasonic energy. By choosing a gap distance specifically selected for a given horn array, the publication suggests improvement of pressure gain in transducer output by 10 dB or better.

Despite enhancement of the effectiveness by this horn array system, there remain significant problems in impedance matching, particularly with ultrasonic emitters.

Many new applications of ultrasonic energy, including parametric speakers, are offering new opportunities which require high levels of efficiency in order to get a commercially acceptable audio output from ultrasonic emissions. Generally, these parametric applications depend on effective impedance matching to enable propagation of ultrasonic waves into the air as the nonlinear medium necessary for acoustic heterodyning.

OBJECTS AND SUMMARY OF THE INVENTION

It is therefore an object of this invention to provide an ultrasonic emitter which is capable of enhanced coupling of emissions which offer even greater power conversion from emitter to surrounding air.

It is a further object to develop an emitter which facilitates propagation of an audio-modulated ultrasonic emission which can decouple in air to provide indirect audio output.

An additional object is to provide an integrated emitter and acoustic transformer which is capable of high efficiency coupling between the emitter and surrounding air environment.

A further object of this invention is to provide a parametric sound system having improved performance, particularly within low frequency ranges.

These and other objects are realized in a sonic emitter array with enhanced emitter-to-air acoustic coupling. The emitter array includes a plate support member having opposing first and second faces separated by an intermediate plate body. The plate body has a plurality of conduits configured as an array of acoustic horns, with each horn having a small throat opening at the first face and an intermediate horn section which diverges to a broad mouth opening at the second face. An emitter membrane is positioned in direct contact with the first face and extends across the small throat openings. The emitter membrane is biased for (i) applying tension to the membrane extending across the throat openings and (ii) displacing the membrane into a non-planar configuration. This non-planar, stretched configuration permits application of a sonic frequency to the membrane for propagation through the intermediate horn section and out the broad mouth opening at the second face.

Numerous specific embodiments can be implemented with a variety of emitters including an emitter having a PVDF (polyvinylidiene di-fluoride) membrane which operates in response to an applied voltage as an active driver element integrally coupled to the acoustic horn. Electrostatic and piezoelectric drivers can similarly be directly coupled to the acoustic horn. These devices are representative of a general methodology for developing a high efficiency acoustic coupling device for coupling ultrasonic emitters to a surrounding air environment, based on the steps of a) integrally attaching an emitter membrane at a small throat opening of an acoustic horn; b) applying sonic frequencies to the emitter membrane to generate sonic compression waves at the small throat opening of the acoustic horn; and c) propagating the sonic compression wave through the acoustic horn for enhanced air coupling at a broad mouth of the horn.

Other objects and features will be apparent to those skilled in the art, based on the following detailed description, taken in combination with the accompanying drawings.

DETAILED DESCRIPTION OF PREFERRED EMBODIMENTS

The following discussion identifies numerous features that form part of the general invention of a horn array which is directly coupled to an emitter which includes an oscillating member for generating sonic waves. Those skilled in the art will appreciate that the specific embodiments disclosed hereafter are representative of the specific embodiments of the present invention, and should not be deemed as limiting, except as sent forth in the accompanying claims.

Figure 2:
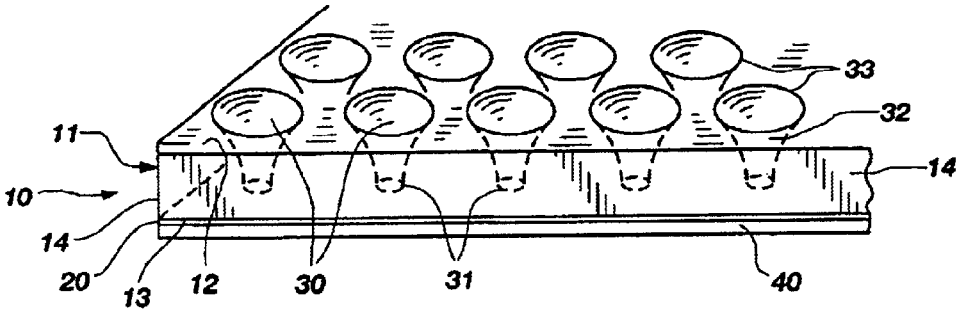
FIG. 2 shows an elevational view of an integral emitter/horn array constructed in accordance with the subject invention.
Figure 3:
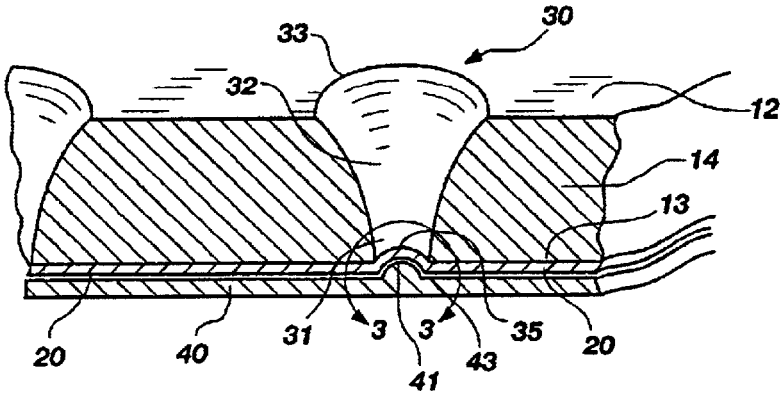
FIG. 3 is a cross-section view of a single horn.

A sonic emitter array 10 is illustrated in FIG. 2. It comprises a plate support member 11 having opposing first and second faces 13 and 12 separated by an intermediate plate body 14. The plate 11 is preferably a rigid material (metal, ceramic, polymer, etc), and may be either conductive or nonconductive, depending on the method of driving an emitter membrane 20 directly coupled to the first face 13. The thickness of the plate will vary, depending on the acoustic coupling properties required for specific frequency ranges and particular applications. Generally, the plate thickness will be within the range of 1 millimeter (mm) to 20 mm. The selection of acoustical, electrical and physical properties will be discussed hereafter.

The plate body includes a plurality of conduits configured as an array of acoustic horns 30. Each horn has a small throat opening 31 at the first face 13 and an intermediate horn section 32 which diverges to a broad mouth opening 33 at the second face 12. The degree of flair in the intermediate horn section, as well as the size of the respective small throat and broad mouth openings 31 and 33 may be configured in accordance with conventional design parameters. These parameters will be balanced and optimized, depending upon the degree of directionality desired, the bandwidth response selected and the gain and coupling efficiency intended. Detailed design considerations are therefore deemed unnecessary for enablement of the present disclosure. Representative dimensions illustrated in FIG. 2 are a 10 mm diameter for the mouth 33, 2 mm diameter for the throat opening, and 10 mm for length or thickness of the plate.

In the illustrated embodiment, the array of horns comprise conduits which are molded to a desired shape within the plate support member for acoustic coupling of ultrasonic frequencies to surrounding air. Appropriate techniques are well known within the injection molding industry for implementing these procedures. Alternatively, the array of horns may have conduits which are machined to the desired shape.

A preferred embodiment of the plate support member comprises circular plate as opposed to the rectangular shape illustrated in FIG. 2. Such a configuration offers an emitted sound column of more uniform nature because of the common radius of the resulting beam output. Dimensions of the plate support member may vary; however, the diameter is generally at least three inches. The configuration may be planar or curved. A concave configuration enables selection of a curvature radius to minimize phase misalignment for a listener location at a predetermined distance from the emitter array. This is accomplished by adjusting the radius of curvature of the emitting face so that the distances from each mouth opening are common at a given listener location. Numerous other variations will be apparent to those of ordinary skill in the art.

Many forms of acoustic emitters may be coupled directly to the opening 31 at the throat of the horn. Selection of a specific emitter will be a function of the intended use of the horn array. Generally these emitters fall within two classes. The first class of emitters comprises those which function as the primary source of mechanical movement for development of compression waves. This class, referred to as acoustic drivers, includes an emitter membrane which is mechanically or physically displaced to create periodic compression waves in a direct or active mode. Examples of the first class of drivers includes piezoelectric emitters, mechanical oscillators, and similar structures which displace in response to energy supplied directly to the membrane. A preferred embodiment conceived as part of the present invention involves the use a film or flexible membrane made of PVDF material. This material has demonstrated surprising utility with respect to direct generation of ultrasonic emissions as will be discussed hereafter. Because PVDF material responds directly to voltage variations, ultrasonic emissions can be directly generated at the small throat opening in a highly controlled manner.

The second class of emitters is characterized by passive or indirect power transmission, rather than in an active or direct mode. Electrostatic and magnetostrictive emitters are representative of this group. Operation of these emitters requires an independent drive source such as a variable voltage back plate or some other driver which passively or indirectly displaces the emitter mounted at the throat opening 31. For example, an electrostatic membrane having a conductive film may be directly coupled at the small opening 31, and pinched or otherwise biased into a state of tension. Ultrasonic electronic signals are applied to a conductive back plate which is electrically insulated from the membrane film, thereby coupling the ultrasonic signal to the electrostatic membrane for generating the desired compression waves through the horn.

Both classes of emitters are positioned in direct contact with the first face 13 and extend across the small throat openings. This is somewhat counter to teachings of the prior art, which have required a displacement gap between the emitter and the small opening of the horn. The present inventors have discovered that by directly attaching the emitter at the first face 13 and in direct position at the throat of the horn develops a highly efficient ultrasonic emission source which couples surprisingly well with a surrounding air environment. Its operability as a parametric propagation source has been effectively demonstrated.

Figure 4:
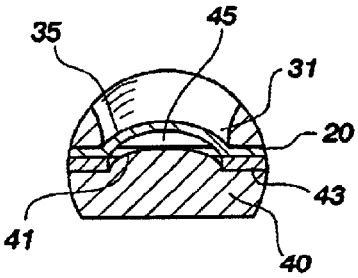
FIG. 4 is a detailed sectional view of the integrated emitter and throat of the horn.

A biasing means is required for enabling the emitter membrane to properly function. This biasing means may be physically or inductively operative with respect to the emitter membrane, but must be capable of (i) applying tension to the membrane extending across the throat openings and (ii) displacing the membrane into a non-planar configuration. This is represented in FIG. 4 et.seq. by the slightly deformed or displaced emitter membrane 35 which is projecting within the small throat opening 31. The emitter membrane is part of a continuous membrane 20 which is disposed across the first face 13 of the plate support member. For example, the deformed emitter membrane 35 may be a preformed dimple positioned within the continuous membrane 20 and in alignment with the opening. The dimpled structure forms part of the biasing means as described above, and would be complemented with a tension force to place the emitter membrane in biased position which permits vibrating motion consonant with a desired ultrasonic signal.

Figure 5:
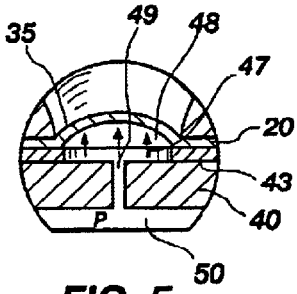
FIGS. 5 through 8 graphically illustrate alternative embodiments demonstrating various methods of displacing the emitter membrane within the small throat opening.

A back plate 40 is positioned behind the membrane and adjacent the small throat openings, and may also serve as part of the biasing means. For example, corresponding dimples 41 can be formed on the back plate in proper alignment to force the emitter membrane within the small throat openings 31. A spacer element 43 may be inserted between the back plate 40 and the emitter membrane 20 to displace the emitter portion 35 from contact with the back plate 40. This may be enhanced by the capture of a pocket of air 45 as a cushion which provides displacement space for the emitter membrane 35. Where PVDF material comprises the emitter membrane, vibration displacements activated by a variable voltage source are of such small distances that the gap formed by the pocket of air 45 may be very small. Alternatively, an outside pressure source P may be applied as illustrated in FIG. 5, wherein the emitter membrane is biased by positive pressure shown by arrows 47. In this case, the air pocket 48 is pressurized through a small conduit 49 which communicates with a plenum 50 or other pressurized source. This also permits uniform pressure on each member of the horn array, providing consistency in output between the respective emitter membranes 35.

Figure 1:
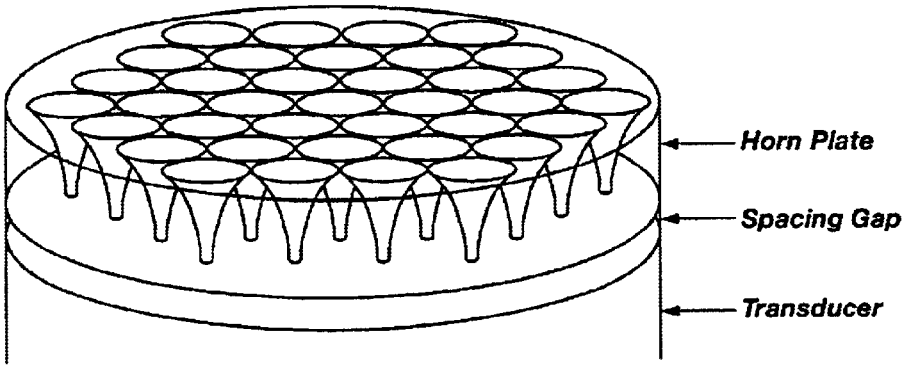
FIG. 1 (PRIOR ART)
FIG. 1 depicts a prior art example of an emitter configuration utilizing an array of horn transformers for acoustic coupling with air.

The spacer element 43 may also be viewed as structure for clamping the membrane in fixed position around the small throat opening such that vibrational energy is not transferred through the membrane to adjacent horns. This same function is performed by the back plate in the absence of the spacer element. Isolation of each emitter element 35 is important for minimizing cross transmission of vibrations through the continuous membrane 20. The spacer and/or back plate also acts as a damping member to reduce vibrations carried through the plate support member 11 (FIG. 1). With each emitter membrane being supplied by a common voltage or energy source, and operating as a continuous membrane having uniform physical properties, the isolated emitter sections 35 can be tuned and electronically or mechanically activated to develop a uniform wave front with minimal distortion. The application of this emitter configuration with an array of horn-type acoustic transformers offers significant advantages over other emitter systems.

The back plate, as shown in FIG. 4, may also include protruding structure 41 aligned with each small throat opening as part of the biasing means. The protruding member operates to displace the emitter membrane slightly and/or to apply proper tension with sufficient displacement allow to activation as a sonic generator. Again, where PVDF material is used, the displacement distance is so nominal that the protruding portion need not extend more than 3 mm. FIGS. 4 through 8 illustrate various geometric shapes that are useful to displace the emitter membrane into the desired non-planar configuration.

The protruding structure 41 shown in FIG. 4 comprises a convex bump having a size approximately equal to the small throat opening such that the bump projects within the throat of the horn. This configuration is very effective in isolating and developing uniform vibration response across the emitter section. The back plate includes means for developing a gap between the convex bump and the membrane to allow vibrational displacement of the membrane when activated with the sonic frequency, thereby avoiding distorting contact with the convex bump. Typical dimensions of the convex bump include a radius of curvature of 10–30 mm and a height of 1–3 mm from the planar surface of the backplate.

An additional method for developing the required gap between the convex bump and the membrane comprises structure for supplying an electrostatic charge operable to repel the membrane from the bump during operation. This can be accomplished by establishing a baseline signal within the PVDF material which maintains a threshold tension, enabling the desired output signal to be applied for the generation of the sonic output in the emitter. It is possible to utilize a carrier signal for this biasing purpose, with sidebands providing the output signal. A similar biasing means can be developed with structure for supplying a magnetic force operable in a manner similar to the electrostatic embodiment to repel the membrane from the bump during operation.

As indicated above, a simple means for developing the required gap between the convex bump and the membrane may consist of a spacer ring positioned between the membrane and the back plate, with the bump being disposed in alignment with a central opening of the spacer ring. This spacer element is representative of numerous forms of mechanical means useful for displacing the emitter membrane from the backplate and bump. The thickness of the spacer will depend upon the range of frequency and amplitude of vibration of the emitter member. Typically, when operating within the ultrasonic range, spacer elements will vary in dimension from 1 to 3 mm. Numerous materials may be selected, balancing such factors as insulative properties, damping constants, expansion coefficients, and chemical/mechanical compatibility with the backplate and the support plate.

Figure 6:
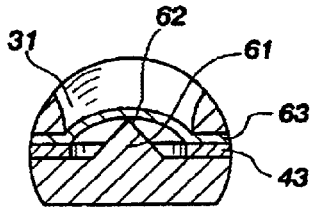
Figure 7:
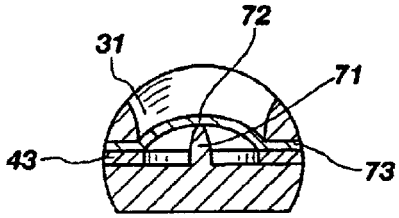
Figure 8:
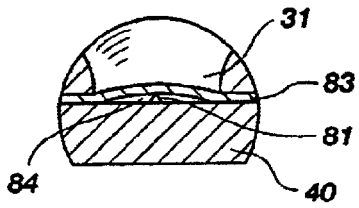

Other forms of mechanical means for developing the gap between the back plate and the membrane are represented in FIGS. 6 to 8. These include a protruding structure having an apex configuration in contact with a central portion of the membrane to physically displace the membrane from the back plate. As an example, FIG. 6 shows a conical structure 61 having an apex 62 in contact with a central portion of the membrane 63 to physically displace the membrane. A further embodiment shown in FIG. 7 comprises a pin structure 71 having an apex 72 in contact with a central portion of the membrane 73. These embodiments may be provided with a spacer 43 to develop the desired gap between the back plate and membrane. The various shapes are to be considered as representative of the general concept that the emitter membrane can be mechanically displaced to provide the biasing and necessary gap for operation within the inventive concept.

FIG. 8 illustrates the placement of the projecting element directly from the back plate without presence of a spacer for gap formation. Instead, a small projection 81 extends at a sufficient length to displace the membrane 83 away from the back plate 40 to provide space for vibration. With minimal displacements such as occur with higher ultrasonic frequencies, small gaps 84 on each side of the projection 81 are sufficient to enable operation of the emitter.

Figure 9:
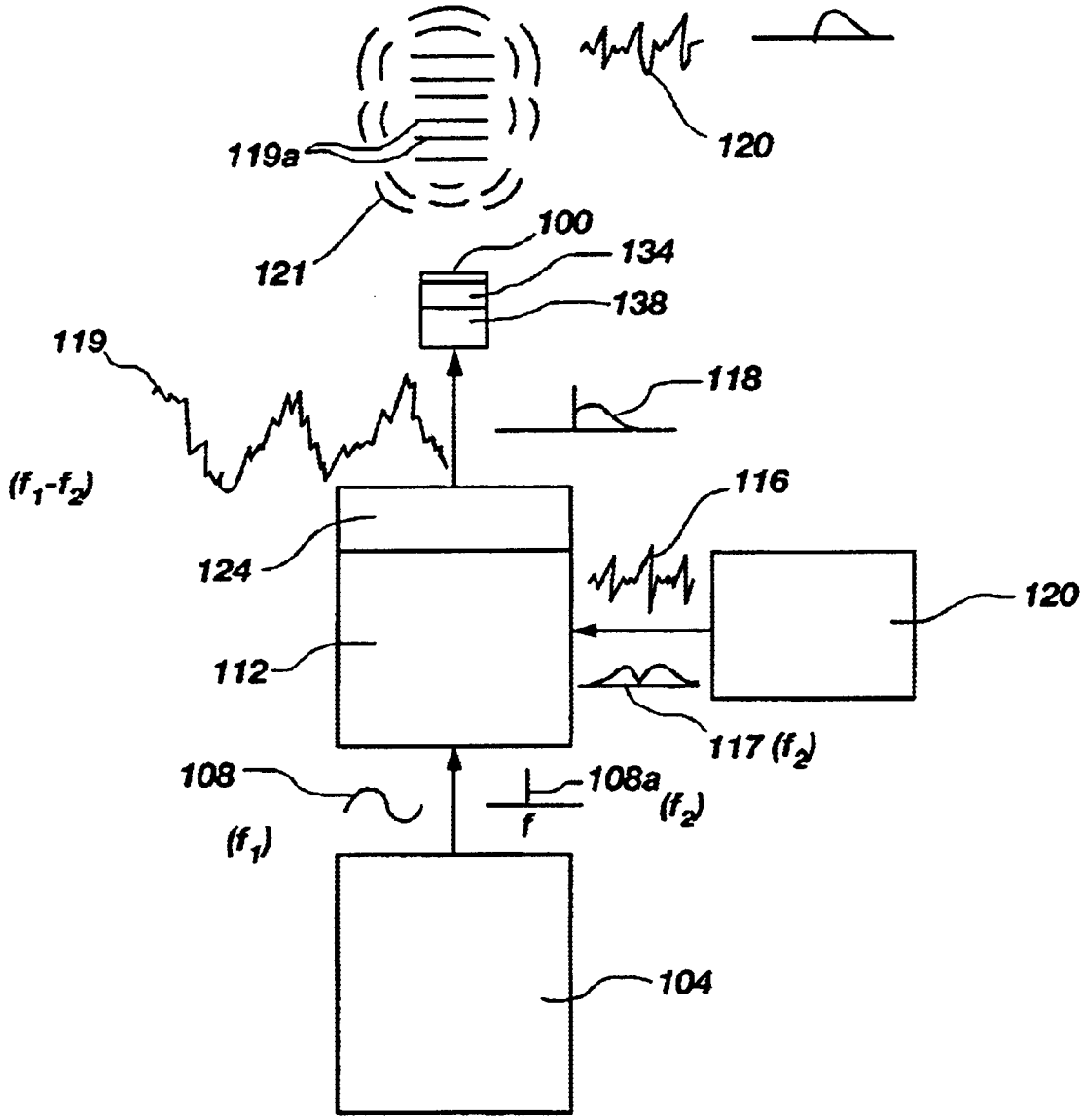
FIG. 9 graphically illustrates an application of the present invention as part of a parametric speaker system for generating audio frequencies from ultrasonic output.

The present invention offers utility in many areas of sonic generation. It is particularly useful in coupling ultrasonic output to surrounding air. The efficiency of this system is most evident with respect to applications with parametric speaker systems where the signal source is coupled to an amplitude modulator for mixing audio frequencies with ultrasonic frequencies to develop an ultrasonic wave form with at least one sideband corresponding to the audio frequencies. The horn array propagates the combined carrier and sideband compression wave within the surrounding air environment which then decouples the audio frequencies to generate audio output as part of an acoustic heterodyne speaker system. Such a system is illustrated in FIG. 9.

This application utilizes a parametric or heterodyning technology, which is particularly adapted for the present thin film structure. The thin electrostatic film of the present invention is well suited for operation at high ultrasonic frequencies in accordance with parametric speaker theory.

A basic system includes an oscillator or digital ultrasonic wave source 104 for providing a base or carrier wave 108. This wave 108 is generally referred to as a first ultrasonic wave or primary wave. An amplitude modulating component 112 is coupled to the output of the ultrasonic generator 104 and receives the base frequency 108 for mixing with a sonic or subsonic input signal 116. The sonic or subsonic signal 116 may be supplied in either analog or digital form, and could be music from any convention signal source 120 or other form of sound. If the input signal 116 includes upper and lower sidebands 117, a filter component 124 may be included in the modulator to yield a single sideband output 118 on the modulated carrier frequency for selected bandwidths.

The diaphragm 100 is caused to emit the ultrasonic frequencies $f_1$ and $f_2$ as a new wave form 116 propagated at the face of the diaphragm 100. This new wave form interacts within the nonlinear medium of air 121 to generate the difference frequency 120, as a new sonic or subsonic wave. The ability to have large quantities of emitter sectors formed in an emitter horn array is particularly well suited for generation of a uniform wave front which can propagate quality audio output at meaningful volumes.

The present invention is able to function as described because the ultrasonic signals corresponding to $f_1$ and $f_2$ interfere in air according to the principles of acoustical heterodyning. Acoustical heterodyning is somewhat of a mechanical counterpart to the electrical heterodyning effect which takes place in a non-linear circuit. For example, amplitude modulation in an electrical circuit is a heterodyning process. The heterodyne process itself is simply the creation of two new waves. The new waves are the sum and the difference of two fundamental waves.

In acoustical heterodyning, the new waves equaling the sum and difference of the fundamental waves are observed to occur when at least two ultrasonic compression waves interact or interfere in air. The preferred transmission medium of the present invention is air because it is a highly compressible medium that responds non-linearly under different conditions. This non-linearity of air enables the heterodyning process to take place, decoupling the difference signal from the ultrasonic output. However, it should be remembered that any compressible fluid can function as the transmission medium if desired.

Whereas successful generation of a parametric difference wave in the prior art appears to have had only nominal volume, the present configuration generates full sound. This full sound is enhanced to impressive volume levels because of the significant increase in coupling efficiency between the emitter diaphragm and the surrounding air.

The development of full volume capacity in a parametric speaker provides significant advantages over conventional speaker systems. Most important is the fact that sound is reproduced from a relatively massless radiating element. Specifically, there is no radiating element operating within the audio range because the film is vibrating at ultrasonic frequencies. This feature of sound generation by acoustical heterodyning can substantially eliminate distortion effects, most of which are caused by the radiating element of a conventional speaker. For example, adverse harmonics and standing waves on the loudspeaker cone, cone overshoot and cone undershoot are substantially eliminated because the low mass, thin film is traversing distances in millimeters.

It should also be apparent from the description above that the preferred and alternative embodiments can emit sonic frequencies directly, without having to resort to the acoustical heterodyning process described earlier. However, the greatest advantages of the present invention are realized when the invention is used to generate the entire range of audible frequencies indirectly using acoustical heterodyning as explained above.

From a procedural perspective, the present invention may be viewed from the following method steps comprising: a) integrally attaching an emitter membrane at a small throat opening of an acoustic horn; b) applying sonic frequencies to the emitter membrane to generate sonic compression waves at the small throat opening of the acoustic horn; and c) propagating the sonic compression wave through the acoustic horn for enhanced air coupling at a broad mouth of the horn. The plate may be formed by preparing a plate support member having opposing first and second faces separated by an intermediate plate body. The plate body includes a plurality of conduits configured as an array of acoustic horns, each horn having a small throat opening at the first face and an intermediate horn section which diverges to a broad mouth opening at the second face. The emitter membrane is positioned in direct contact with the first face and extends across the small throat openings. Biasing means is provided to the emitter membrane for (i) applying tension to the membrane extending across the throat openings and (ii) displacing the membrane into a non-planar configuration. Finally, a sonic frequency is imposed on the membrane for propagation through the intermediate horn section and out the broad mouth opening at the second face.

It will be apparent to those skilled in the art that the present disclosure is merely representative of the basic inventive concepts set forth in the following claims. For example, other variations will be recognized, such as biasing the emitter membrane by coupling a back plate directly against the emitter membrane to pinch the membrane at the small throat opening and isolate the membrane from adjacent acoustic horns within the plate support member. Furthermore, the emitter membrane may perform the additional step of actively driving the generation of compression waves within the acoustic horn, as opposed to passive or inductive methods generally described in this disclosure.

We claim:

1. A sonic emitter array with enhanced emitter-to-air acoustic coupling, said emitter comprising:

a plate support member having opposing first and second faces separated by an intermediate plate body, said plate body having a plurality of conduits configured as an array of acoustic horns, each horn having a small throat opening at the first face and an intermediate horn section which diverges to a broad mouth opening at the second face;

an emitter membrane positioned in direct contact with the first face and extending across the small throat openings;

biasing means operable with respect to the emitter membrane for (i) applying tension to the membrane extending across the throat openings and (ii) displacing the membrane into a non-planar configuration;

means for applying a sonic frequency to the membrane for propagation through the intermediate horn section and out the broad mouth opening at the second face; and a back plate positioned behind the membrane and adjacent the small throat openings, said back plate including contact structure for clamping the membrane in fixed position around the small throat opening such that vibrational energy is not transferred through the membrane to adjacent horns.

2. A sonic emitter array as defined in claim 1, wherein the back plate includes protruding structure aligned with each small throat opening, said protruding structure providing means for displacing the membrane into the non-planar configuration.

3. A sonic emitter array as defined in claim 2, wherein the protruding structure comprises a convex bump having a size approximately equal to the small throat opening, said back plate including means for developing a gap between the convex bump and the membrane to allow vibrational displacement of the membrane when activated with the sonic frequency without contact with the convex bump.

4. A sonic emitter array as defined in claim 3, wherein the means for developing the gap between the convex bump and the membrane comprises structure for supplying an electrostatic charge operable to repel the membrane from the bump during operation.

5. A sonic emitter array as defined in claim 3, wherein the means for developing the gap between the convex bump and the membrane comprises structure for supplying a differential air pressure operable to maintain the gap during operation.

6. A sonic emitter array as defined in claim 3, wherein the means for developing the gap between the convex bump and the membrane comprises structure for supplying a magnetic force operable to repel the membrane from the bump during operation.

7. A sonic emitter array as defined in claim 3, wherein the means for developing the gap between the convex bump and the membrane comprises a spacer ring positioned between the membrane and the back plate, said bump being disposed in alignment with a central opening of the spacer ring.

8. A sonic emitter array as defined in claim 3, wherein the means for developing the gap between the back plate and the membrane comprises protruding structure having an apex in contact with a central portion of the membrane to physically displace the membrane from the back plate during operation, said contact of the apex with the membrane being sufficiently nominal to allow transfer of the sonic frequency to the membrane as an emitter.

9. A sonic emitter array as defined in claim 2, wherein the protruding structure comprises a conical structure having an apex in contact with a central portion of the membrane to physically displace the membrane from the back plate during operation, said contact of the apex with the membrane being sufficiently nominal to allow transfer of the sonic frequency to the membrane as an emitter.

10. A sonic emitter array as defined in claim 2, wherein the protruding structure comprises a pin structure having an apex in contact with a central portion of the membrane to physically displace the membrane from the back plate during operation, said contact of the apex with the membrane being sufficiently nominal to allow transfer of the sonic frequency to the membrane as an emitter.

11. A sonic emitter array as defined in claim 1, wherein said plate support member is comprised of an electrically conductive material which is capable of carrying a voltage for supplying the sonic frequency to the membrane.

12. A sonic emitter array as defined in claim 1, wherein the membrane comprises a PVDF material responsive to voltage changes to generate physical vibrations at the small throat opening as a sonic emitter.

13. A sonic emitter array as defined in claim 12, wherein the means for applying a sonic frequency to the membrane comprises a voltage signal source coupled to the membrane and operable to supply a variable signal which is converted by the PVDF material of the membrane into compression waves.

14. A sonic emitter array as defined in claim 13, wherein the signal source comprises an ultrasonic signal generator which is coupled to an amplitude modulator for mixing audio frequencies with ultrasonic frequencies to develop an ultrasonic wave form having at least one sideband corresponding to the audio frequencies, said sonic emitter providing ultrasonic compression waves propagating from the horn array within a surrounding air environment which decouples the audio frequencies to generate audio output as part of an acoustic heterodyne speaker system.

15. A sonic emitter array as defined in claim 1, wherein the membrane comprises a dielectric material responsive to electrostatic voltage changes to generate physical vibrations at the small throat opening as an electrostatic sonic emitter, said back plate comprising a conductive medium capable of driving the electrostatic sonic emitter at the sonic frequencies.

16. A sonic emitter array as defined in claim 15, wherein the means for applying a sonic frequency to the membrane comprises a voltage signal source coupled to the back plate and operable to supply a variable signal which is converted by the dielectric material of the membrane into compression waves.

17. A sonic emitter array as defined in claim 16, wherein the signal source comprises an ultrasonic signal generator which is coupled to an amplitude modulator for mixing audio frequencies with ultrasonic frequencies to develop an ultrasonic wave form having at least one sideband corresponding to the audio frequencies, said sonic emitter providing ultrasonic compression waves propagating from the horn array within a surrounding air environment which decouples the audio frequencies to generate audio output as part of an acoustic heterodyne speaker system.

18. A sonic emitter array as defined in claim 1, wherein the plate support member comprises circular plate.

19. A sonic emitter array as defined in claim 18, wherein the circular plate is planar in configuration.

20. A sonic emitter array as defined in claim 18, wherein the circular plate is concave in configuration, having a radius of curvature selected to minimize phase misalignment at a listener location at a predetermined distance from the emitter array.

21. A sonic emitter array as defined in claim 1, wherein plate support member includes an emitter array having a diameter of at least three inches.

22. A sonic emitter array as defined in claim 1, wherein the array of horns comprise conduits which are molded to a desired shape within the plate support member for acoustic coupling of ultrasonic frequencies to surrounding air.

23. A sonic emitter array as defined in claim 1, wherein the array of horns comprise conduits which are machined to a desired shape within the plate support member for acoustic coupling of ultrasonic frequencies to surrounding air.

24. A sonic emitter array as defined in claim 1, wherein the membrane is preformed with an array of dimples positioned for alignment with the small throat openings of the horn array to provide the non-planar configuration as part of the biasing means.

25. A sonic emitter array as defined in claim 24, wherein the array of dimples are uniform in size and acoustic response to generate a substantially common wave front at the second face of the plate support member.

26. An emitter array as defined in claim 1, wherein the means for applying a sonic frequency to the membrane comprises directly applying one or more voltage sources to the membrane, wherein oscillating the voltage source at a predetermined frequency can induce the membrane to produce acoustic waves proportional to the predetermined frequency.

27. An emitter array as defined in claim 26, wherein a separate voltage source is applied to the membrane at each of the acoustic horns.

28. An emitter array as defined in claim 26, wherein the predetermined frequency is greater than 20 kHz.

29. An emitter array as defined in claim 1, the means for applying a sonic frequency comprises:

an ultrasonic wave source configured to provide an ultrasonic carrier signal;

an audio signal source configured to provide an audio signal; and a modulator coupled to the ultrasonic wave source and the audio signal source, wherein the modulator is configured to mix the ultrasonic carrier signal and the audio signal to produce at least one of an upper sideband and a lower sideband corresponding to the audio signal.

30. An emitter array as defined in claim 29, further comprising a filter component configured to filter at least one of the upper sideband and the lower sideband.

31. An emitter array as defined in claim 29, wherein the emitter array is configured as part of a parametric speaker system.

32. A method for developing a high efficiency acoustic coupling device for coupling ultrasonic emitters to a surrounding air environment, said method comprising the steps of:

a) attaching an emitter membrane at a small throat opening of an acoustic horn;

b) applying sonic frequencies to the emitter membrane to generate sonic compression waves at the small throat opening of the acoustic horn;

c) propagating the sonic compression wave through the acoustic horn for enhanced air coupling at a broad mouth of the horn;

d) forming an array of acoustic horns by preparing a plate support member having opposing first and second faces separated by an intermediate plate body, said plate body having a plurality of conduits configured as an array of acoustic horns, each horn having a small throat opening at the first face and an intermediate horn section which diverges to a broad mouth opening at the second face;

e) positioning the emitter membrane in direct contact with the first face and extending across the small throat openings;

f) biasing the emitter membrane for (i) applying tension to the emitter membrane extending across the throat openings and (ii) displacing the emitter membrane into a non-planar configuration;

g) applying the sonic frequencies to the emitter membrane for propagation through the intermediate horn section and out the broad mouth opening at the second face; and h) coupling a back plate against the emitter membrane to pinch the membrane at the small throat opening and isolating the emitter membrane from adjacent acoustic horns within the plate support member.

33. A method as defined in claim 32, wherein the emitter membrane performs the additional step of actively driving the generation of sonic compression waves within the acoustic horn.

34. A method as defined in claim 32, wherein the step of applying sonic frequencies further comprises the step of configuring an amplitude modulator for mixing audio frequencies with an ultrasonic carrier signal to develop an ultrasonic wave form with at least one sideband signal corresponding to the audio frequencies.

35. A method as defined in claim 34, further comprising the step of configuring the array as part of a parametric speaker.

36. A method as defined in claim 34, further comprising the step of applying the ultrasonic waveform with at least one sideband signal to the membrane to propagate a parametric acoustic wave comprising the ultrasonic carrier frequency and the sideband signal, wherein a difference between the ultrasonic carrier frequency and the sideband signal creates audible sound relating to the audio frequencies.

* * * * *